US010940083B2

(12) United States Patent
Chen et al.

(10) Patent No.: US 10,940,083 B2
(45) Date of Patent: Mar. 9, 2021

(54) ADJUSTABLE RESPIRATOR SHELL

(71) Applicants: INDUSTRIAL TECHNOLOGY RESEARCH INSTITUTE, Hsin-Chu (TW); Chang Gung Medical Foundation Lin-Kou Chang Gung Memorial Hospital, Tao-Yuan (TW)

(72) Inventors: Ting-Hsuan Chen, Zhubei (TW); Chun-Hua Wang, Taipei (TW); Chung-Hsin Su, Hsinchu (TW); Jo-Ping Lee, Tainan (TW)

(73) Assignees: INDUSTRIAL TECHNOLOGY RESEARCH INSTITUTE, Hsin-Chu (TW); CHANG GUNG MEDICAL FOUNDATION LIN-KOU CHANG GUNG MEMORIAL HOSPITAL, Tao-Yuan (TW)

( * ) Notice: Subject to any disclaimer, the term of this patent is extended or adjusted under 35 U.S.C. 154(b) by 583 days.

(21) Appl. No.: 15/856,790

(22) Filed: Dec. 28, 2017

(65) Prior Publication Data

US 2019/0159964 A1 May 30, 2019

(30) Foreign Application Priority Data

Nov. 28, 2017 (TW) ..... 106141435

(51) Int. Cl.
*A61H 31/02* (2006.01)
*A61H 1/00* (2006.01)

(52) U.S. Cl.
CPC ..... *A61H 31/02* (2013.01); *A61H 1/00* (2013.01); *A61H 2031/025* (2013.01);
(Continued)

(58) Field of Classification Search
CPC .... A61H 31/02; A61H 2031/025; A61H 1/00; A61M 16/0816; A61M 16/0605;
(Continued)

(56) References Cited

U.S. PATENT DOCUMENTS 2,490,395 A * 12/1949 Wilm ..... A61H 31/02 601/44
2,772,673 A 12/1956 Huxley, III
(Continued)

FOREIGN PATENT DOCUMENTS

CN 101406426 A 4/2009
CN 102258833 A 11/2011
(Continued)

OTHER PUBLICATIONS

Intellectual Property Office Ministry of Economic Affairs, R.O.C., Office Action, Jul. 18, 2018, Taiwan.
(Continued)

*Primary Examiner* — Samchuan C Yao
*Assistant Examiner* — Cana A Gallegos
(74) *Attorney, Agent, or Firm* — Locke Lord LLP; Tim Tingkang Xia, Esq.

(57) ABSTRACT

An adjustable respirator shell, suitable for being worn on a human body trunk, includes a body, a belt and a buffer. The body includes a protrusive portion and a contact portion. The protrusive portion has an opening connecting a fluid pressure controller, and the contact portion is to contact the human body trunk. The belt, connecting the body, is to surround the human body trunk so as to fasten the adjustable respirator shell on the human body trunk. The buffer covers a circumference of the contact portion, and the contact portion contacts the human body trunk via the buffer. In addition, the buffer includes at least one cushion.

20 Claims, 10 Drawing Sheets

(52) U.S. Cl.
CPC ..... *A61H 2201/0103* (2013.01); *A61H 2201/0134* (2013.01); *A61H 2201/0192* (2013.01); *A61H 2201/1409* (2013.01); *A61H 2201/165* (2013.01); *A61H 2201/1621* (2013.01); *A61H 2201/5071* (2013.01); *A61H 2201/5087* (2013.01); *A61H 2205/08* (2013.01)

(58) Field of Classification Search
CPC ..... A61M 16/06; A61M 16/0611; A61M 16/0616; A61M 16/0622; A61M 16/0627; A61M 16/0633; A61M 16/0644; A61F 5/012; A61F 5/05816; A61F 5/02; A61F 5/022; A61F 5/024; A61F 5/026; A61F 5/028; A61F 5/03
USPC ..... 602/13, 19
See application file for complete search history.

(56) References Cited

U.S. PATENT DOCUMENTS

| | | | | |
|---|---|---|---|---|
| 3,043,292 | A | 7/1962 | Mendelson | |
| 4,257,407 | A | 3/1981 | Macchi | |
| 4,815,452 | A | 3/1989 | Hayek | |
| 4,971,042 | A | 11/1990 | Lerman | |
| 4,982,735 | A | 1/1991 | Yagata et al. | |
| 5,076,259 | A | 12/1991 | Hayek | |
| 5,573,498 | A | 11/1996 | Hayek | |
| 5,820,572 | A | 10/1998 | Palmer | |
| 6,059,742 | A | 5/2000 | Palmer | |
| 6,273,087 | B1 | 8/2001 | Boussignac et al. | |
| 6,345,618 | B1 | 2/2002 | Hayek | |
| 6,409,954 | B1 | 6/2002 | Mulligan | |
| 6,533,739 | B1 | 3/2003 | Palmer et al. | |
| 6,951,546 | B2 | 10/2005 | Palmer et al. | |
| 7,297,125 | B2 | 11/2007 | Palmer et al. | |
| 8,276,588 | B1 * | 10/2012 | Connor | A61M 16/0616 128/206.24 |
| 8,336,549 | B2 | 12/2012 | Nashed | |
| 8,490,623 | B2 | 7/2013 | Berthon-Jones et al. | |
| 2006/0185675 | A1 * | 8/2006 | Colin | A61M 16/06 128/206.24 |
| 2010/0024811 | A1 * | 2/2010 | Henry | A61M 16/0633 128/202.16 |
| 2011/0313332 | A1 | 12/2011 | Rahman et al. | |
| 2017/0361045 | A1 * | 12/2017 | Fu | A61M 16/024 |
| 2018/0272096 | A1 * | 9/2018 | Rubin | A61M 16/06 |

FOREIGN PATENT DOCUMENTS

| | | | |
|---|---|---|---|
| CN | 103987419 | A | 8/2014 |
| CN | 105664268 | A | 6/2016 |
| CN | 107072872 | A | 8/2017 |
| TW | M243214 | | 9/2004 |
| TW | M253359 | | 12/2004 |
| TW | M293022 | | 7/2006 |
| TW | M442137 | U | 12/2012 |
| TW | M480997 | | 7/2014 |

OTHER PUBLICATIONS https:://www.youtube.com/watch?v=4dThZY1FiGE, Aug. 24, 2017.
Taiwan Patent Office, "Office Action", Dec. 6, 2018, Taiwan.
China Patent Office, "Office Action", Sep. 27, 2020, China.

* cited by examiner

ADJUSTABLE RESPIRATOR SHELL

CROSS REFERENCE TO RELATED APPLICATION

This application claims the benefits of Taiwan application Serial No. 106141435, filed Nov. 28, 2017, the disclosures of which are incorporated by references herein in its entirety.

TECHNICAL FIELD

The present disclosure relates in general to an adjustable respirator shell, and more particularly to an adjustable respirator shell for pulmonary rehabilitation.

BACKGROUND

Generally, a respirator shell used for pulmonary rehabilitation is known as one of non-invasive respiratory aid equipment. For a purpose of waiving the intubation and the tracheostomy from patients, a respirator shell is purposely provided to a patient, and an external pressure is then introduced into the respirator shell so as to inflate/deflate forcedly the cage of chest of the patient, so that exhaling/inhaling of the patient can be promoted, respectively.

Clinically, a fluid pressure controller is applied to produce periodically negative pressures and positive pressures inside the respirator shell. Practically, the respirator shell usually cooperates a positive-pressure ventilator in an emergency room or an intensive care unit. Also, the respirator shell can be applied for rehabilitation exercise programs in medical facilitates or for domestic training so as to aid respiration of patients having limitations of chest expansion or obstructive pulmonary diseases, and thereby the lung oxygen content of the corresponding patient can be substantially increased.

Nevertheless, the conventional respirator shell has the following clinical shortcomings. (1) Though the respirator shell can be furnished with particular sizes, yet a problem of sealing is always there due to its complicated configuration, from which results of pulmonary rehabilitation therapies by negative pressures would be substantially affected. (2) Due to this problem, cracks may happen to edge portions that contact the trunk after a long-term usage, especially at both armpits of the trunk.

Accordingly, an improvement upon the respirator shell that can base on a body type of the patient to determine necessary gas charge for ensuring contact sealing and also can resolve the aforesaid crack problem at edges of the respirator shell is definitely urgent to the skill in the art.

SUMMARY

In one embodiment of this disclosure, an adjustable respirator shell, suitable for being worn on a human body trunk, comprises a body, a belt and a buffer. The body includes a protrusive portion and a contact portion, where the protrusive portion has an opening connecting to a fluid pressure controller, and the contact portion is to contact the human body trunk. The belt, attached to the body, is to surround the human body trunk so as to fasten the adjustable respirator shell on the human body trunk. The buffer covers a circumference of the contact portion, and the contact portion contacts the human body trunk via the buffer. In addition, the buffer includes at least one cushion.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
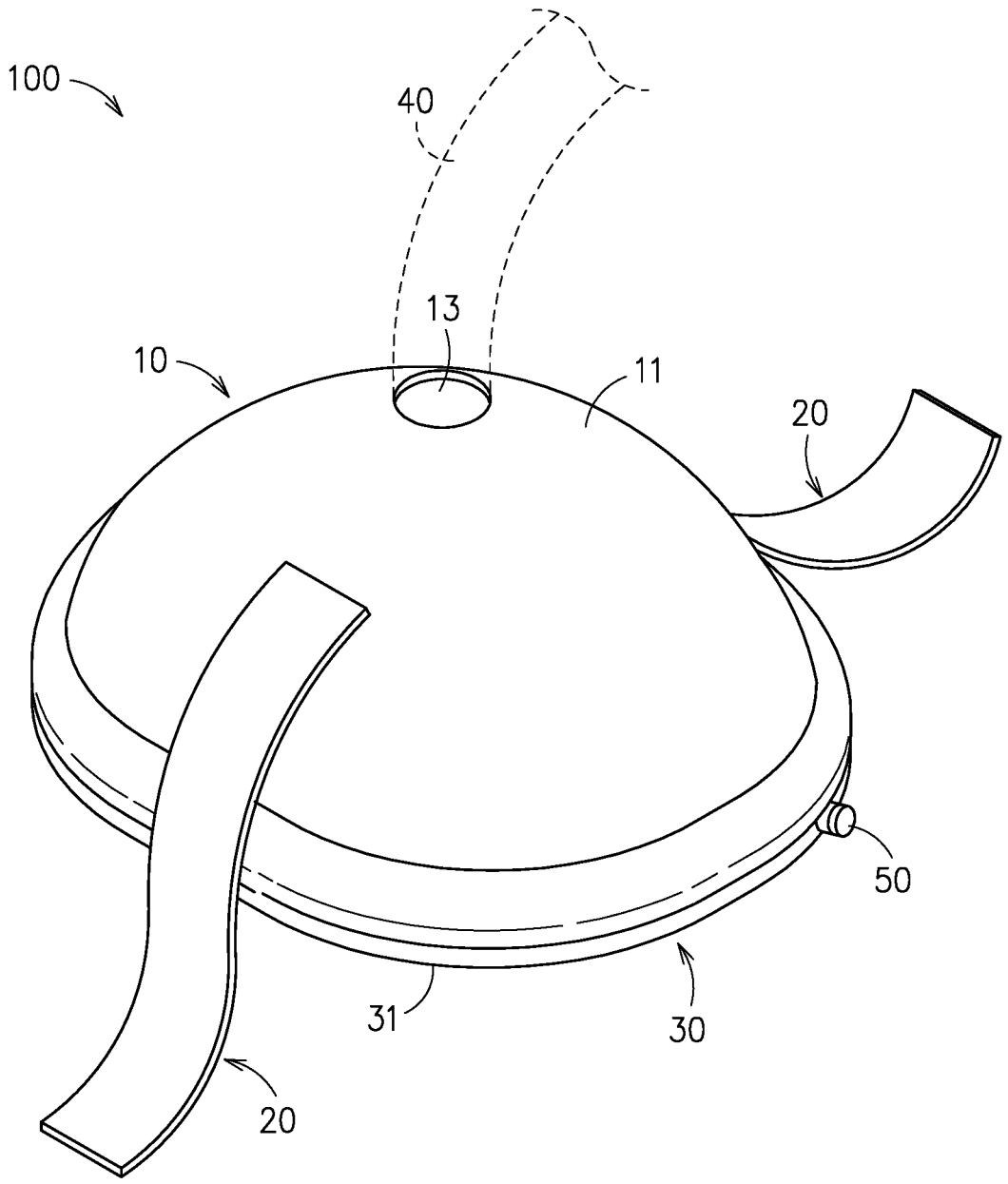
FIG. 1 is a schematic perspective view of an embodiment of the adjustable respirator shell in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
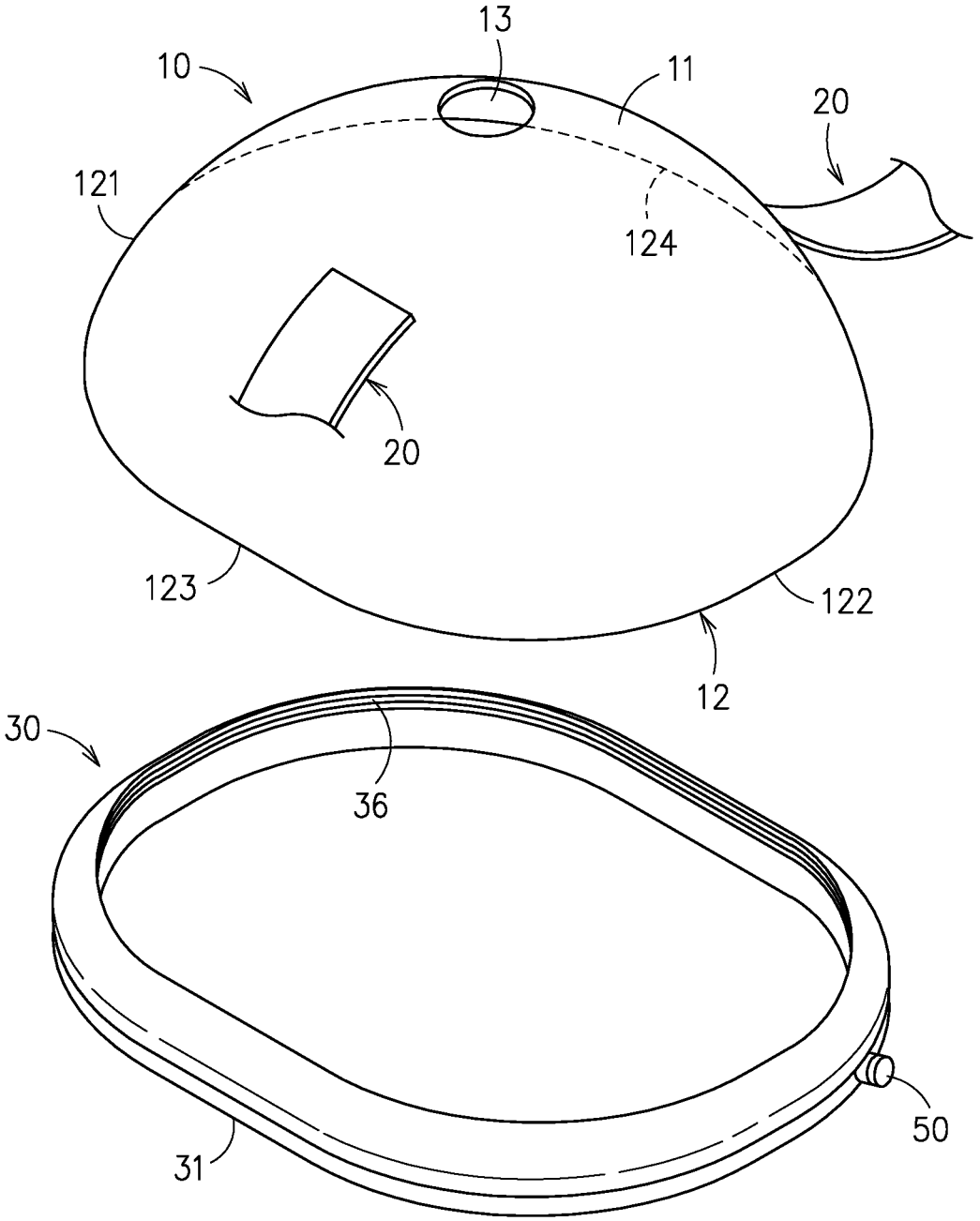
FIG. 2 is a schematic exploded view of FIG. 1.
Figure 3:
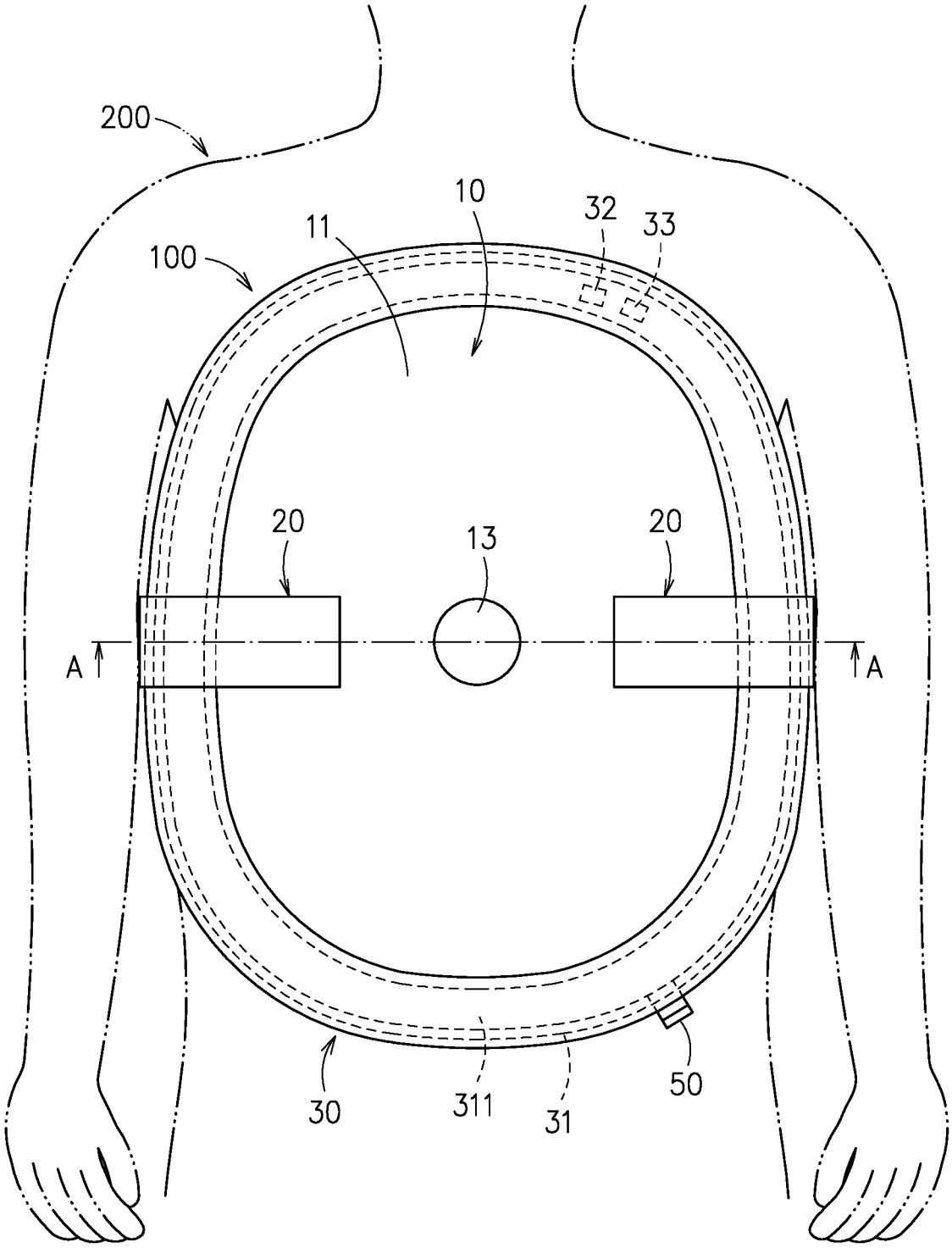
FIG. 3 is a schematic view of the adjustable respirator shell of FIG. 1 worn on a human body trunk.

Referring to FIG. 1 through FIG. 3, an embodiment of the adjustable respirator shell 100 comprises at least a body 10, a belt 20 and a buffer 30, suitable for being worn on a human body trunk 200. The buffer 30 is detachably disposed on the body 10.

Referring to FIG. 1 through FIG. 3, the body 10 includes a protrusive portion 11 and a contact portion 12 formed to be a circumference of the protrusive portion 11. The protrusive portion 11 has an opening 13 at a top thereof for connecting to an external fluid pressure controller. As shown in FIG. 1 to FIG. 3, a connection pipe 40 can be applied to connect between the opening 13 and the fluid pressure controller (not shown in the figure). The contact portion 12 for contacting the human body trunk 200 includes an upper chest rim 121, a lower belly rim 122 and two lateral belly rims 123, 124. The upper chest rim 121 is suitable for contacting a sternum area of the human body trunk 200, the lower belly rim 122 is suitable for contacting a lower belly portion of the human body trunk 200, and the two lateral belly rims 123, 124 are suitable for contacting two respective lateral belly portions of the human body trunk 200.

As shown, the belt 20 is attached to the body 10. In particular, in this embodiment, the belt 20 is, but not limited to, a two-section strip structure having two opposing ends to be joined by a connection means such as Velcro fasteners, hooks, buckles or the like. While in applying the adjustable respirator shell 100, the adjustable respirator shell 100 is firstly introduced to cover a chest of the human body trunk 200, and then two ends of the belt 20 are pulled around to a back of the human body trunk 200, such that the connection means (Velcro fasteners, hooks, buckles or the like) can connect the two ends of the belt 20 so as to fix the adjustable respirator shell 100 tightly on the human body trunk 200.

Referring to FIG. 2 through FIG. 5, the buffer 30 covers the contact portion 12 by sleeving over the body 10. As shown in FIG. 2, a buckle groove 36 is disposed in the buffer 30 for buckling and covering the circumference of the contact portion 12. Namely, the contact portion 12 contacts to the human body trunk 200 via the buffer 30. The buffer 30 includes a cushion 31 further having a chamber 311. In this embodiment, since the body 10 has an oval circumference, thus the buffer 30, the cushion 31 and the chamber 311 are all annular. A pressure detector 32 and an airflow detector 33 are disposed on a contact surface between the cushion 31 and the human body trunk 200, respectively, so as to detect a pressure on the contact surface and airflow over the contact surface, respectively. Also, the cushion 31 has a gas-adjusting valve 50. In addition, the cushion 31 is connected with one end of a ventilation pipe 34, while another end of the ventilation pipe 34 is connected to a fluid pressure controller (not shown in the figure). The ventilation pipe 34 includes a first part 341 and a second part 342. The first part 341 is located inside the body 10, and the second part 342 is located out of the body 10. In particular, the first part 341 and the second part 342 are connected detachably by a connection nut 35. An internal layer 14 can be disposed inside the body 10 by a distance d1 between the protrusive portion 11 and the internal layer 14, such that a double-layer structure can be formed to provide a middle space for accommodating the first part 341 of the ventilation pipe 34 between the internal layer 14 and the protrusive portion 11. Similarly, another internal layer 41 can be disposed inside the connection pipe 40 so as to construct another double-layer structure for accommodating the second part 342 of the ventilation pipe 34 between the internal layer 41 and the connection pipe 40. In particular, a distance d2 is between the internal layer 41 and the connection pipe 40.

In this disclosure, the buffer 30 and the cushion 31 can be produced by any appropriate material, identical or different materials, such as a compressible hermetic resin, silicone or the like.

Figure 4:
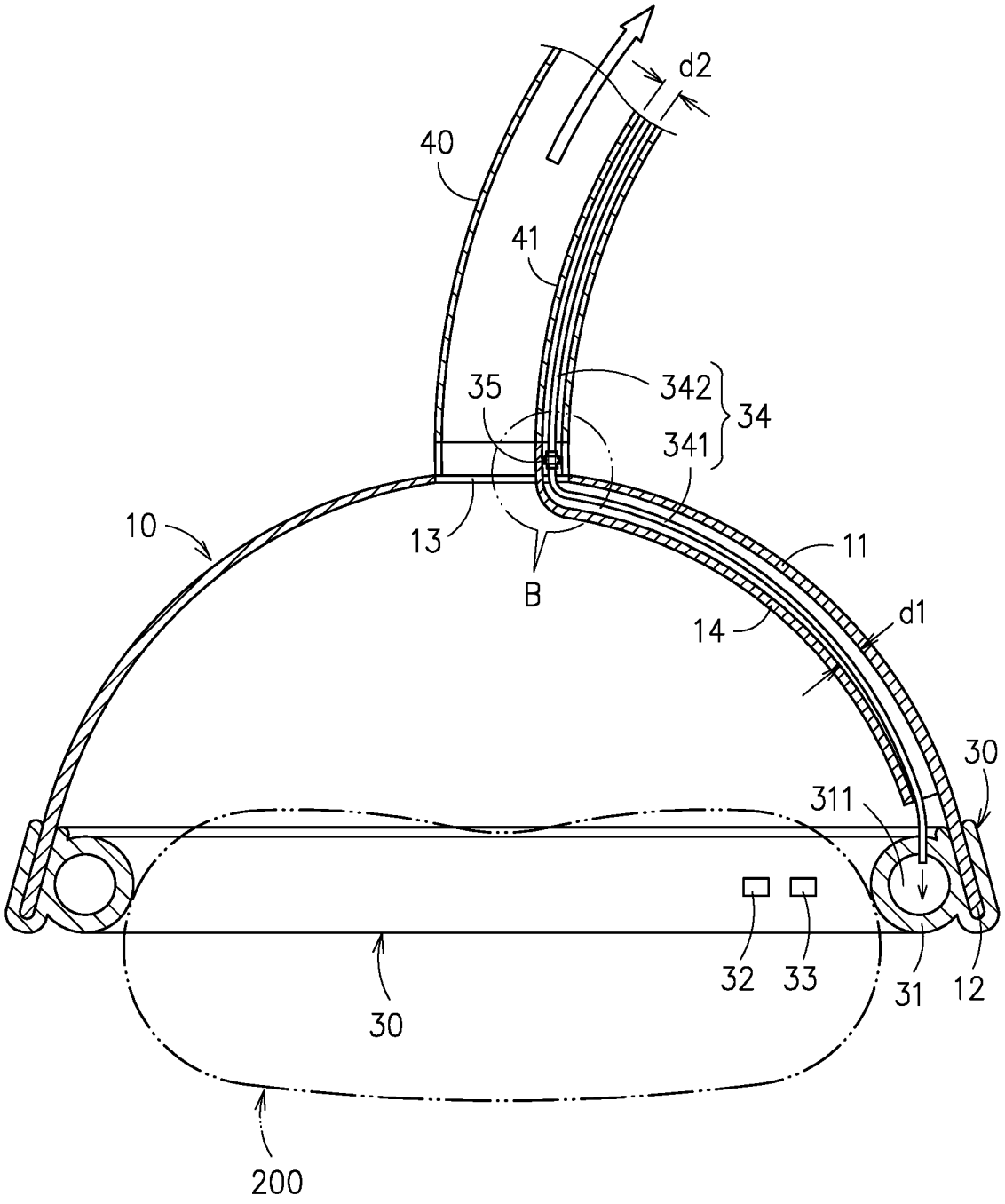
FIG. 4 is a schematic cross-sectional view of FIG. 3 along line A-A, by neglecting the belt.
Figure 5:
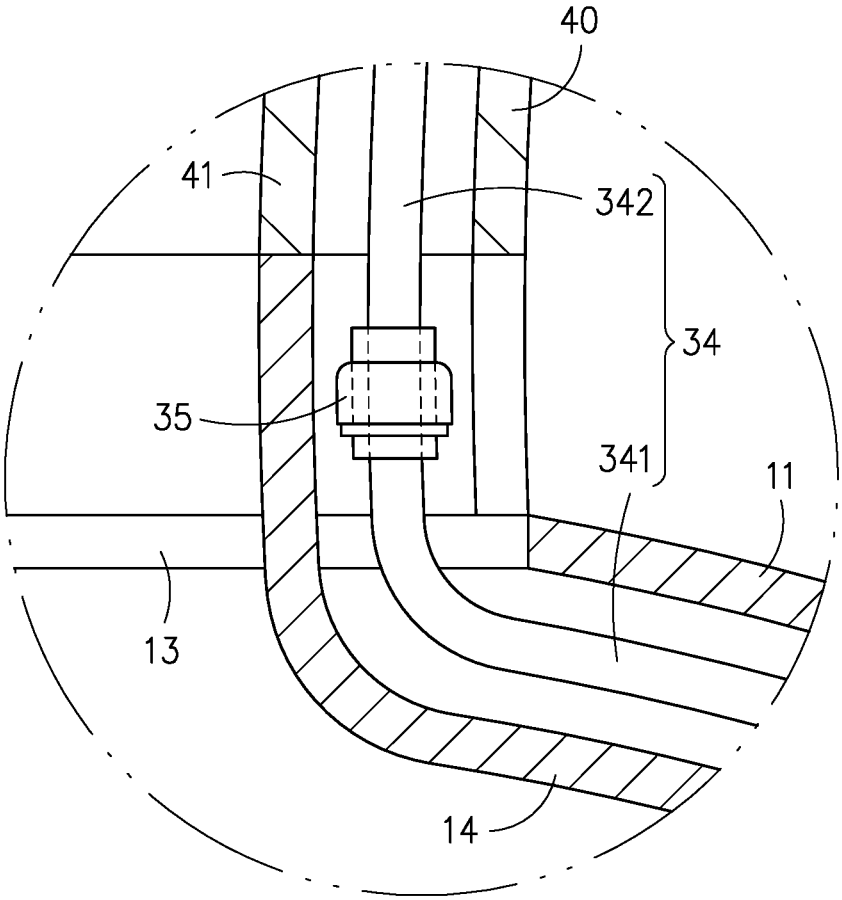
FIG. 5 is a schematic enlarged view of area B of FIG. 4.

Referring now to FIG. 3 and FIG. 4, the fluid pressure controller would send the gas into the cushion 31 via the ventilation pipe 34. By having the pressure detector 32 and the airflow detector 33 to detect a pressure on the contact surface and airflow over the contact surface, respectively, and by transmitting detecting signals to an user interface or a mainframe device in a wireless or cabling manner, then the internal pressure and pressure cycling can thus be controlled. In the case that the pressure has not reached a predetermined pressure, then gas filling will be continued. On the other hand, in the case that the pressure is too high, it implies that the gas filling is over a saturated state, and thus the gas-adjusting valve 50 is applied to exhaust a portion of the internal gas, or the ventilation pipe 34 can be used to vacuum the gas, such that the gas state inside the cushion 31 can be properly managed.

In addition, while the fluid pressure controller vacuums through the connection pipe 40, a negative pressure would be formed between the adjustable respirator shell 100 and the human body trunk 200. In details, while in wearing the adjustable respirator shell 100 on the human body trunk 200, the upper chest rim 121, the lower belly rim 122 and the two lateral belly rims 123, 124 of the contact portion 12 are fixed to respective portions of the human body trunk 200. The cushion 31 is used to perform a further adjustment of the contact therebetween, so that the adjustable respirator shell 100 can fit the human body trunk 200 better. Thereby, an airtight chamber would be formed between the human body trunk 200 and the body 10 of the adjustable respirator shell 100. By having the gas to be filled into or vacuumed from the chamber by the gas-supplying apparatus at the end of the connection pipe 40, then respective positive or negative pressure would be formed in the airtight chamber between the human body trunk 200 and the body 100, and thus the cage of chest would be deflated or inflated forcedly, so that inhaling or exhaling of the patient can be promoted, respectively. Thereupon, the object of enhancing pulmonary rehabilitation by introducing the adjustable respirator shell of this disclosure can be obtained.

Figure 6:
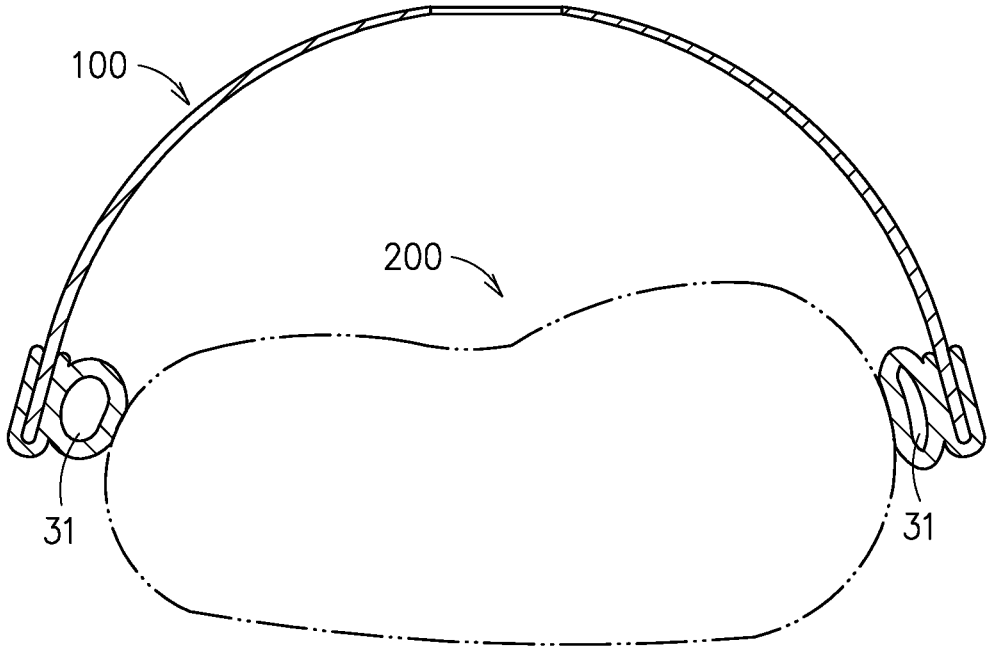
FIG. 6 is a schematic view showing that the adjustable respirator shell of this disclosure is worn on another human body trunk.

Referring to FIG. 6, for the cushion 31 is able to adjust the volume and pressure state of the compressible gas, thus the adjustable respirator shell 100 provided by this disclosure can be suitable for various human body trunks 200 with different curvatures and symmetries. As shown in FIG. 6, it demonstrates that the adjustable respirator shell 100 of this disclosure can fit an asymmetric human body trunk 200, simply by providing different compressive states to two lateral sides of the cushion 31.

Figure 7:
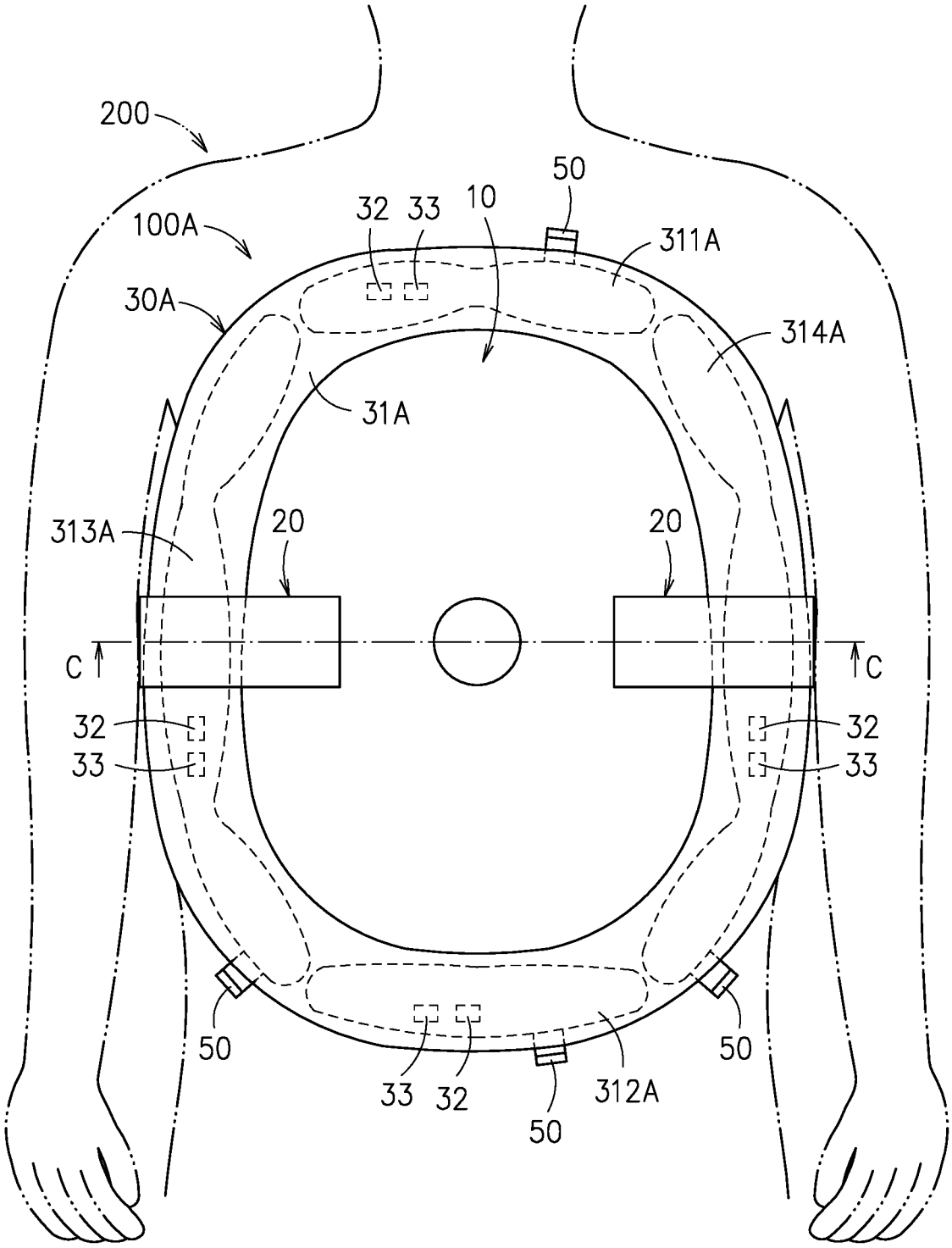
FIG. 7 is a schematic view of another embodiment of the adjustable respirator shell in accordance with this disclosure, worn on a further human body trunk.
Figure 8:
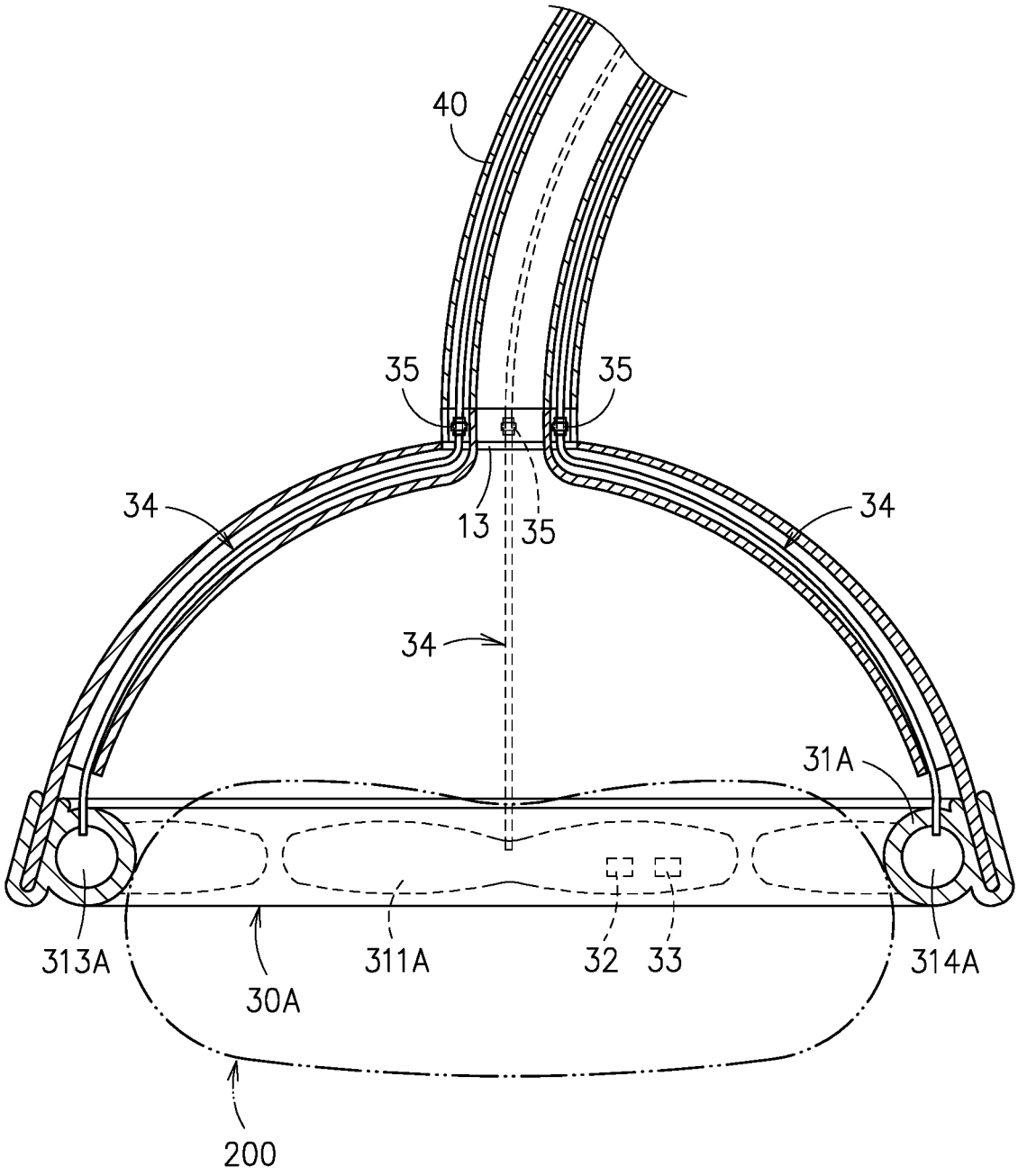
FIG. 8 is a schematic cross-sectional view of FIG. 7 along line C-C, by neglecting the belt.

Referring to FIG. 7 and FIG. 8, another adjustable respirator shell 100A of this disclosure comprises a body 10, a belt 20 and a buffer 30A. The buffer 30A covers the circumference of the contact portion 12 of the body 10, and the contact portion 12 contacts the human body trunk 200 via the buffer 30A. The buffer 30A has a cushion 31A.

Referring to FIG. 2, FIG. 7 and FIG. 8, the cushion 31A includes four chambers 311A-314A in correspondence with the upper chest rim 121, the lower belly rim 122 and the two lateral belly rims 123, 124 of the contact portion 12, respectively. The cushion 31A has a two-segment gas-communicating chamber 311A corresponding to the upper chest rim 121 of the contact portion 12, a three-segment gas-communicating chamber 313A, 314A corresponding to each of the two lateral belly rims 123, 124 of the contact portion 121, and a single-segment chamber 312A corresponding to the lower belly rim 122 of the contact portion 12. Each of the chambers 311A-314A includes a gas-adjusting valve 50, a pressure detector 32 and an airflow detector 33, and is connected with one end of the ventilation pipe 34 having the connection nut 35; while another end of the ventilation pipe 34 is connected to the fluid pressure controller. Arrangements of the chambers, the ventilation pipe and the fluid pressure controller are the same as those depicted in FIG. 4 and FIG. 5. Since the fluid pressure controller pumps the gas to the chambers 311A-314A individually, pressures and airflows at the respective contact surfaces between the human body trunk 200 and the individual chambers 311A-314A are detected by the corresponding pressure detectors 32 and the corresponding airflow detectors 33. In each said chamber, if the pressure has not reached a predetermined pressure, then gas filling will be continued. On the other hand, in each said chamber, if the pressure is too high, it implies that the gas filling is over a saturated state, and thus the gas-adjusting valve 50 would exhaust a portion of the internal gas so as to adjust the gas state inside the corresponding chamber. Further, the fluid pressure controller can vacuum through the connection pipe 40, such that a negative pressure can be formed between the adjustable respirator shell 100A and the human body trunk 200.

Figure 9:
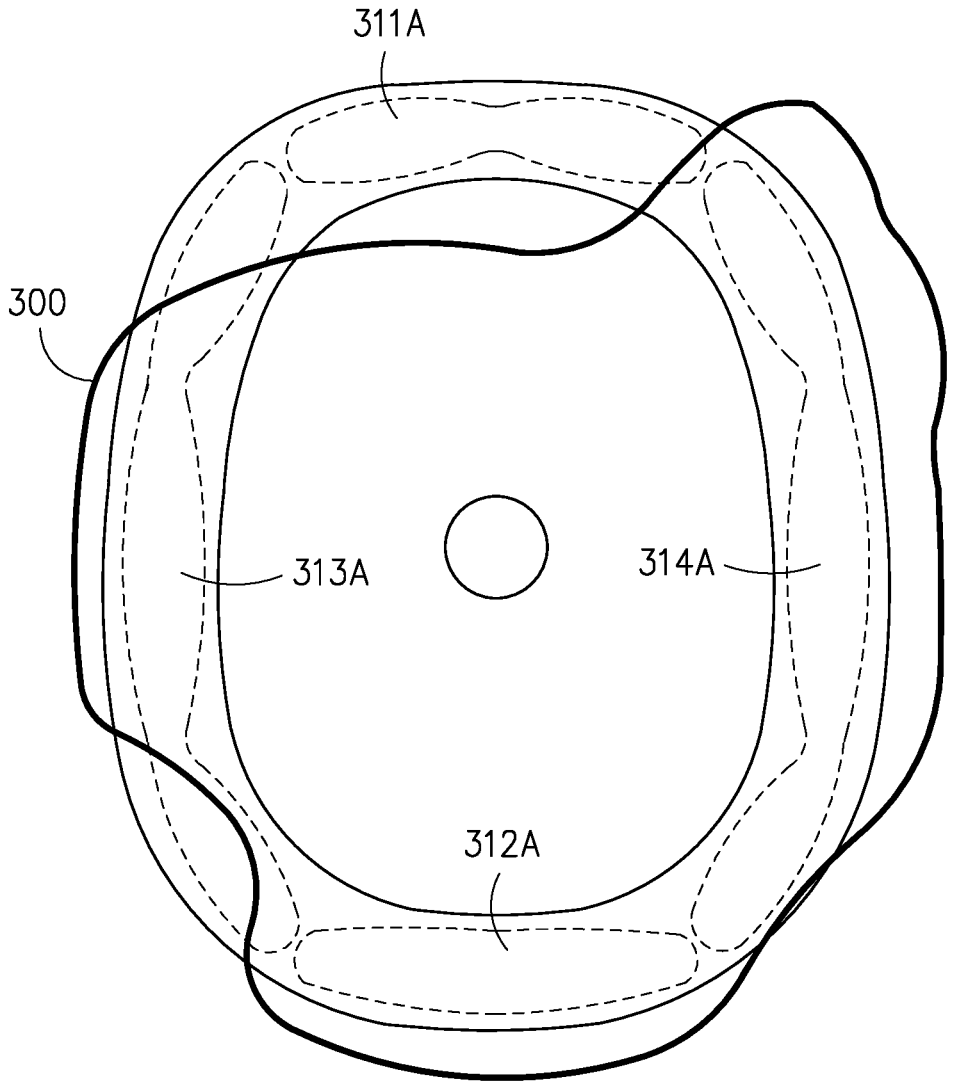
FIG. 9 is a schematic view demonstrating adjusted inflation capacities according to pressure changes upon the embodiment of FIG. 7.

Referring now to FIG. 9, a pressure distribution analyzing curve 300 in correspondence with these four chambers 311A-314A is shown. In FIG. 9, the pressure under chamber 311A is insufficient, while that under chamber 314A is too high. Thus, it can be determined that the chamber 311A should be inflated, while the chamber 314A should be exhausted.

Figure 10:
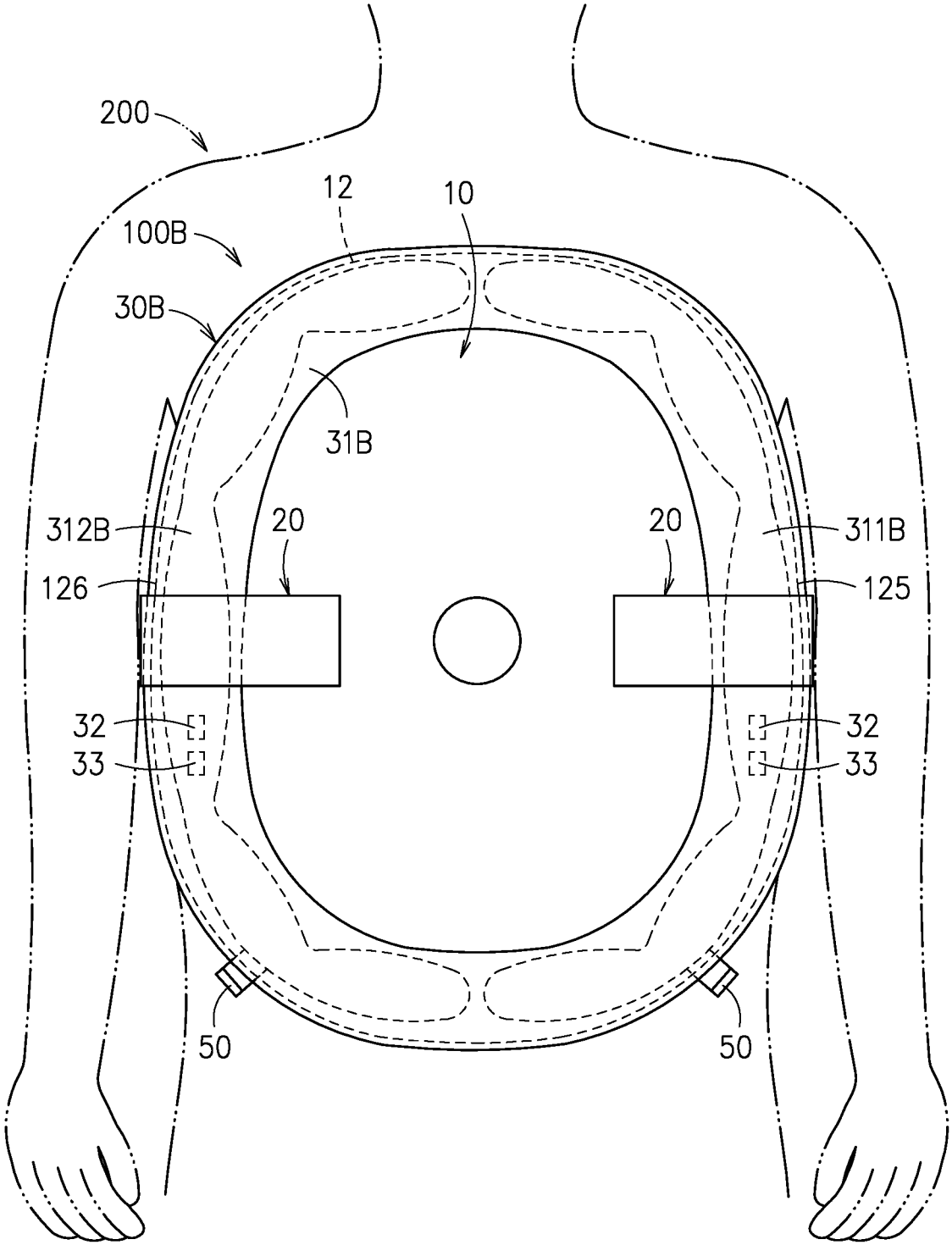
FIG. 10 is a schematic view of a further embodiment of the adjustable respirator shell in accordance with this disclosure, worn on a human body trunk.

Referring now to FIG. 10, an adjustable respirator shell 100B is shown to include a body 10, a belt 20 and a buffer 30B. In this embodiment, the contact portion 12 includes a left chest rim 125 and a right chest rim 126. The left chest rim 125 is suitable for being fixed to the left chest and the left lateral portion of the human body trunk 200, while the right chest rim 126 is suitable for being fixed to the right chest and the right lateral portion. The cushion 31B has two five-segment gas-communicating chambers 311B, 312B in correspondence with the left chest rim 125 and the right chest rim 126 of the contact portion 12, respectively. Each of the two chambers 311B, 312B includes a gas-adjusting valve 50, a pressure detector 32 and an airflow detector 33, and is connected with the fluid pressure controller via the ventilation pipe 34. Arrangements of the chambers, the ventilation pipe and the fluid pressure controller are the same as those depicted in FIG. 4 and FIG. 5.

In summary, the adjustable respirator shell provided by this disclosure includes the buffer furnished with the cushion. By having the compressible buffer to serve between the contact portion and the human body trunk, the adaptation of the adjustable respirator shell with respect to wearer's body style can be thus enhanced. Also, the conventional cracking problem at edges of the respirator shell can be resolved as well. By viewing foregoing embodiments shown in FIG. 3, FIG. 7 and FIG. 10, respectively, different designs in chambering are provided. No matter what the chamber is annular, multi-segment or structurally mixed, the common feature thereamong is the inclusion of the buffer having the cushion.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. An adjustable respirator shell, suitable for being worn on a human body trunk, comprising:

a body, including a protrusive portion and a contact portion, the protrusive portion having an opening connecting to a fluid pressure controller, the contact portion configured to contact the human body trunk;

a belt, attaching to the body, configured to surround and fasten the adjustable respirator shell on the human body trunk; and a buffer, covering a circumference of the contact portion, the contact portion configured to contact the human body trunk via the buffer;

wherein the buffer includes at least one cushion, the at least one cushion is connected with one end of a ventilation pipe, another end of the ventilation pipe is connected to a fluid pressure controller, the ventilation pipe includes at least a first part and a second part, the first part is located inside the body, and the second part is located out of the body.

2. The adjustable respirator shell of claim 1, wherein the at least one cushion has a gas-adjusting valve for adjusting a gas state inside the at least one cushion.

3. The adjustable respirator shell of claim 1, wherein the at least one cushion has a multi-segment gas-communicating chamber.

4. The adjustable respirator shell of claim 1, wherein the contact portion includes an upper chest rim, a lower belly rim and two lateral belly rims, the upper chest rim is suitable for contacting a sternum area of the human body trunk, the lower belly rim is suitable for contacting a lower belly portion of the human body trunk, and the two lateral belly rims are suitable for contacting two lateral belly portions of the human body trunk.

5. The adjustable respirator shell of claim 4, wherein the at least one cushion has a two-segment gas-communicating chamber in correspondence with the upper chest rim of the contact portion.

6. The adjustable respirator shell of claim 4, wherein the at least one cushion has two three-segment gas-communicating chambers in correspondence individually with the two lateral belly rims of the contact portion.

7. The adjustable respirator shell of claim 1, wherein the contact portion includes a left chest rim and a right chest rim, the left chest rim is suitable for contacting a left chest and a left lateral portion of the human body trunk, and the right chest rim is suitable for contacting a right chest and a right lateral portion of the human body trunk.

8. The adjustable respirator shell of claim 7, wherein the at least one cushion in correspondence with the left chest rim of the contact portion has a five-segment gas-communicating chamber.

9. The adjustable respirator shell of claim 7, wherein the at least one cushion in correspondence with the right chest rim of the contact portion has a five-segment gas-communicating chamber.

10. The adjustable respirator shell of claim 1, wherein the at least one cushion has at least one pressure detector for detecting a pressure on a contact surface between the at least one cushion and the human body trunk, and at least one airflow detector for detecting an airflow over the contact surface.

11. The adjustable respirator shell of claim 1, wherein the first part and the second part are detachably connected by a connection nut.

12. The adjustable respirator shell of claim 1, wherein the body includes an internal layer disposed inside the body by a distance between the protrusive portion and the internal layer, such that a double-layer structure is formed for accommodating the ventilation pipe between the internal layer and the protrusive portion.

13. An adjustable respirator shell, suitable for being worn on a human body trunk, comprising:

a body, including a protrusive portion and a contact portion, the protrusive portion having an opening connecting to a fluid pressure controller, the contact portion configured to contact the human body trunk;

a belt, attaching to the body, configured to surround and to fasten the adjustable respirator shell on the human body trunk; and a buffer, covering a circumference of the contact portion, the contact portion configured to contact the human body trunk via the buffer, wherein the contact portion includes an upper chest rim, a lower belly rim and two lateral belly rims, the upper chest rim is suitable for contacting a sternum area of the human body trunk, the lower belly rim is suitable for contacting a lower belly portion of the human body trunk, and the two lateral belly rims are suitable for contacting two lateral belly portions of the human body trunk;

wherein the buffer includes at least one cushion, and the at least one cushion has four chambers in correspondence individually with the upper chest rim, the lower belly rim and the two lateral belly rims, respectively.

14. The adjustable respirator shell of claim 13, wherein the at least one cushion in correspondence with the upper chest rim has a two-segment gas-communicating chamber, and the at least one cushion in correspondence with each of the two lateral belly rims has a three-segment gas-communicating chamber.

15. The adjustable respirator shell of claim 13, wherein the at least one cushion has a two-segment gas-communicating chamber in correspondence with the upper chest rim of the contact portion.

16. The adjustable respirator shell of claim 13, wherein the at least one cushion has two three-segment gas-communicating chambers in correspondence individually with the two lateral belly rims of the contact portion.

17. An adjustable respirator shell, suitable for being worn on a human body trunk, comprising:

a body, including a protrusive portion and a contact portion, the protrusive portion having an opening connecting to a fluid pressure controller, the contact portion configured to contact the human body trunk;

a belt, attaching to the body, configured to surround and to fasten the adjustable respirator shell on the human body trunk; and a buffer, covering a circumference of the contact portion, the contact portion configured to contact the human body trunk via the buffer, wherein the contact portion includes a left chest rim and a right chest rim, the left chest rim is suitable for contacting a left chest and a left lateral portion of the human body trunk, and the right chest rim is suitable for contacting a right chest and a right lateral portion of the human body trunk;

wherein the buffer includes at least one cushion, and the at least one cushion includes two chambers in correspondence individually with the left chest rim and the right chest rim of the contact portion.

18. The adjustable respirator shell of claim 17, wherein the at least one cushion in correspondence with the left chest rim of the contact portion has a five-segment gas-communicating chamber.

19. The adjustable respirator shell of claim 17, wherein the at least one cushion in correspondence with the right chest rim of the contact portion has a five-segment gas-communicating chamber.

20. An adjustable respirator shell, suitable for being worn on a human body trunk, comprising:

a body, including a protrusive portion and a contact portion, the protrusive portion having an opening connecting to a fluid pressure controller, the contact portion configured to contact the human body trunk;

a belt, attaching to the body, configured to surround and fasten the adjustable respirator shell on the human body trunk; and a buffer, covering a circumference of the contact portion, the contact portion configured to contact the human body trunk via the buffer;

wherein the buffer includes at least one cushion, the at least one cushion is connected with one end of a ventilation pipe, another end of the ventilation pipe is connected to a fluid pressure controller, wherein the body includes an internal layer disposed inside the body by a distance between the protrusive portion and the internal layer, such that a double-layer structure is formed for accommodating the ventilation pipe between the internal layer and the protrusive portion.

* * * * *